US011911872B2

(12) United States Patent
Takada et al.

(10) Patent No.: US 11,911,872 B2
(45) Date of Patent: Feb. 27, 2024

(54) SUBSTRATE PROCESSING APPARATUS AND SUBSTRATE PROCESSING METHOD

(71) Applicant: Ebara Corporation, Tokyo (JP)

(72) Inventors: Nobuyuki Takada, Tokyo (JP); Hozumi Yasuda, Tokyo (JP)

(73) Assignee: Ebara Corporation, Tokyo (JP)

( * ) Notice: Subject to any disclaimer, the term of this patent is extended or adjusted under 35 U.S.C. 154(b) by 355 days.

(21) Appl. No.: 17/166,521

(22) Filed: Feb. 3, 2021

(65) Prior Publication Data

US 2021/0237221 A1 Aug. 5, 2021

(30) Foreign Application Priority Data

Feb. 5, 2020 (JP) ..... 2020-018110

(51) Int. Cl.
*B24B 9/06* (2006.01)
*B24B 37/30* (2012.01)
(Continued)

(52) U.S. Cl.
CPC ..... *B24B 9/065* (2013.01); *B24B 37/042* (2013.01); *B24B 37/30* (2013.01); *B24B 49/04* (2013.01); *B24B 49/10* (2013.01); *B24B 49/12* (2013.01)

(58) Field of Classification Search
CPC ..... B24B 7/228; B24B 7/04; B24B 7/042; B24B 37/10; B24B 37/107; B24B 37/30;
(Continued)

(56) References Cited

U.S. PATENT DOCUMENTS 8,113,918 B2 * 2/2012 Koo ..... H01L 21/68728 451/388
8,382,554 B2 * 2/2013 Kim ..... B24B 49/16 451/41
(Continued)

FOREIGN PATENT DOCUMENTS

JP 2003-229388 A 8/2003
JP 2004-517479 A 6/2004
(Continued)

OTHER PUBLICATIONS

Machine translation of JP2003229388 (Year: 2003).*

*Primary Examiner* — Joel D Crandall
*Assistant Examiner* — Robert F Neibaur
(74) *Attorney, Agent, or Firm* — Leydig, Voit & Mayer, Ltd.

(57) ABSTRACT

Polishing uniformity of a surface to be polished of a substrate is improved by appropriately according with a state of the surface to be polished during polishing. A substrate processing apparatus includes a table 100 for supporting a substrate WF, a pad holder 226 for holding a polishing pad 222 for polishing the substrate WF supported by the table 100, an elevating mechanism for elevating the pad holder 226 with respect to the substrate WF, a swing mechanism for swinging the pad holder 226 in a radial direction of the substrate WF, supporting members 300A and 300B for supporting the polishing pad 222 swung to outside the table 100 by the swing mechanism, and driving mechanisms 310 and 320 for adjusting at least one of a height and a distance to the substrate WF of the supporting member 300 while polishing the substrate WF.

11 Claims, 14 Drawing Sheets

(51) Int. Cl.

| | |
|---|---|
| ***B24B 49/04*** | (2006.01) |
| ***B24B 49/10*** | (2006.01) |
| ***B24B 37/04*** | (2012.01) |
| ***B24B 49/12*** | (2006.01) |

(58) Field of Classification Search

CPC ..... B24B 37/32; B24B 47/12; B24B 49/03; B24B 49/16

USPC ..... 451/5, 9, 10, 11, 14, 24, 41, 285, 287, 451/363, 398, 413

See application file for complete search history.

(56) References Cited

U.S. PATENT DOCUMENTS

| | | | | |
|---|---|---|---|---|
| 10,016,871 | B2 * | 7/2018 | Shinozaki | B24B 53/017 |
| 2008/0200100 | A1 * | 8/2008 | Takahashi | H01L 21/67219 438/692 |
| 2011/0021115 | A1 | 1/2011 | Oh et al. | |
| 2016/0099156 | A1 * | 4/2016 | Yamaguchi | H01L 21/02065 438/692 |
| 2018/0001438 | A1 * | 1/2018 | Sakugawa | B24B 37/005 |

FOREIGN PATENT DOCUMENTS

| | | | |
|---|---|---|---|
| JP | 2011-029643 | A | 2/2011 |
| WO | WO 2002/053322 | A2 | 7/2002 |

* cited by examiner

SUBSTRATE PROCESSING APPARATUS AND SUBSTRATE PROCESSING METHOD

TECHNICAL FIELD

This application relates to a substrate processing apparatus and a substrate processing method. This application claims priority from Japanese Patent Application No. 2020-18110 filed on Feb. 5, 2020. The entire disclosure including the descriptions, the claims, the drawings, and the abstracts in Japanese Patent Application No. 2020-18110 is herein incorporated by reference.

BACKGROUND ART

There is a Chemical Mechanical Polishing (CMP) apparatus as a type of a substrate processing apparatus used in a semiconductor processing operation. The CMP apparatus can be roughly divided into a "face-up type (method where a surface to be polished of a substrate faces upward)" and a "face-down type (method where the surface to be polished of the substrate faces downward)" depending on a direction that the surface to be polished of the substrate faces.

PTL 1 discloses a face-up CMP apparatus that polishes a substrate by bringing a polishing pad having a diameter smaller than that of the substrate into contact with the substrate and swinging the polishing pad while rotating the polishing pad. This CMP apparatus discloses disposing a supporting member in a peripheral area of the substrate to support the polishing pad caused to swing to outside the substrate with the supporting member and making a height and a position in a horizontal direction of the supporting member adjustable.

CITATION LIST

Patent Literature

PTL 1: Japanese Unexamined Patent Application Publication No. 2003-229388

SUMMARY OF INVENTION

Technical Problem

However, the technique described in PTL 1 does not consider adjusting the supporting member in accordance with a state of the surface to be polished of the substrate during polishing.

That is, the height adjustment of the supporting member in PTL 1 is for making heights of a support surface of the supporting member and the surface to be polished of the substrate approximately the same. A horizontal direction movement of the supporting member in PTL 1 is for moving the supporting member to a position far from the substrate such that the supporting member does not become a hindrance when the substrate is loaded and for moving the supporting member to a position close to the substrate after the loading finishes. Accordingly, the adjustment of the supporting member described in PTL 1 is difficult to appropriately accord with a state of the surface to be polished of the substrate during polishing, thereby sometimes causing a problem in polishing uniformity of the surface to be polished of the substrate.

Therefore, one objective of this application is to appropriately accord with a state of a surface to be polished of a substrate during polishing to improve polishing uniformity of the surface to be polished.

Solution to Problem

According to one embodiment, there is disclosed a substrate processing apparatus including: a table for supporting a substrate; a pad holder for holding a polishing pad for polishing the substrate supported by the table; an elevating mechanism for elevating the pad holder with respect to the substrate; a swing mechanism for swinging the pad holder in a radial direction of the substrate; a supporting member for supporting the polishing pad swung to outside the table by the swing mechanism; and a driving mechanism for adjusting at least one of a height and a distance to the substrate of the supporting member while polishing the substrate.

DESCRIPTION OF EMBODIMENTS

Figure 1:
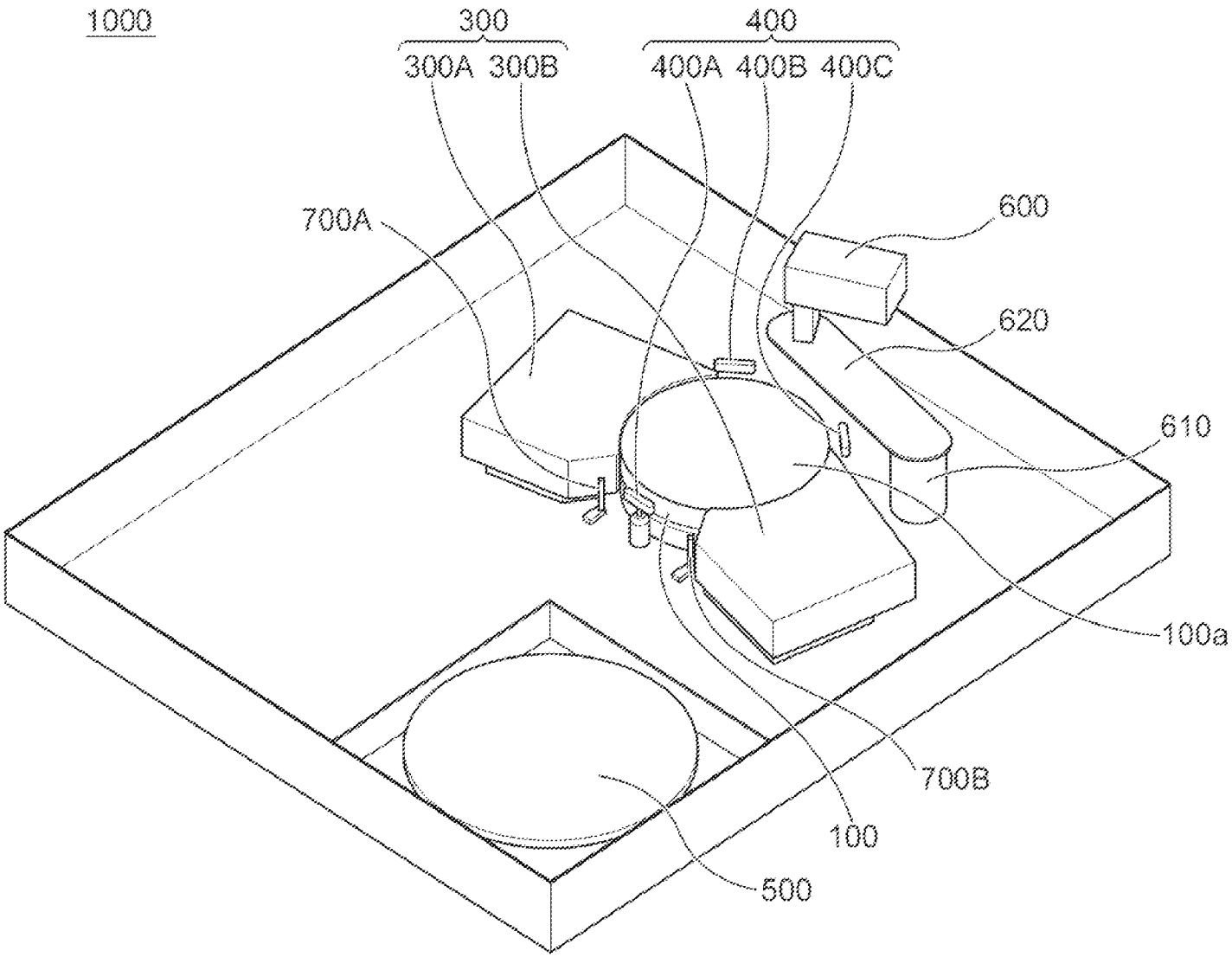
FIG. 1 is a perspective view schematically illustrating an overall configuration of a substrate processing apparatus according to one embodiment.

The following describes embodiments of a substrate processing apparatus and a substrate processing method according to the present invention with reference to the attached drawings. In the attached drawings, identical or similar reference numerals are attached to identical or similar components, and overlapping description regarding the identical or similar components may be omitted in the description of the respective embodiments. Features illustrated in the respective embodiments are applicable to other embodiments in so far as they are consistent with one another.

Figure 2:
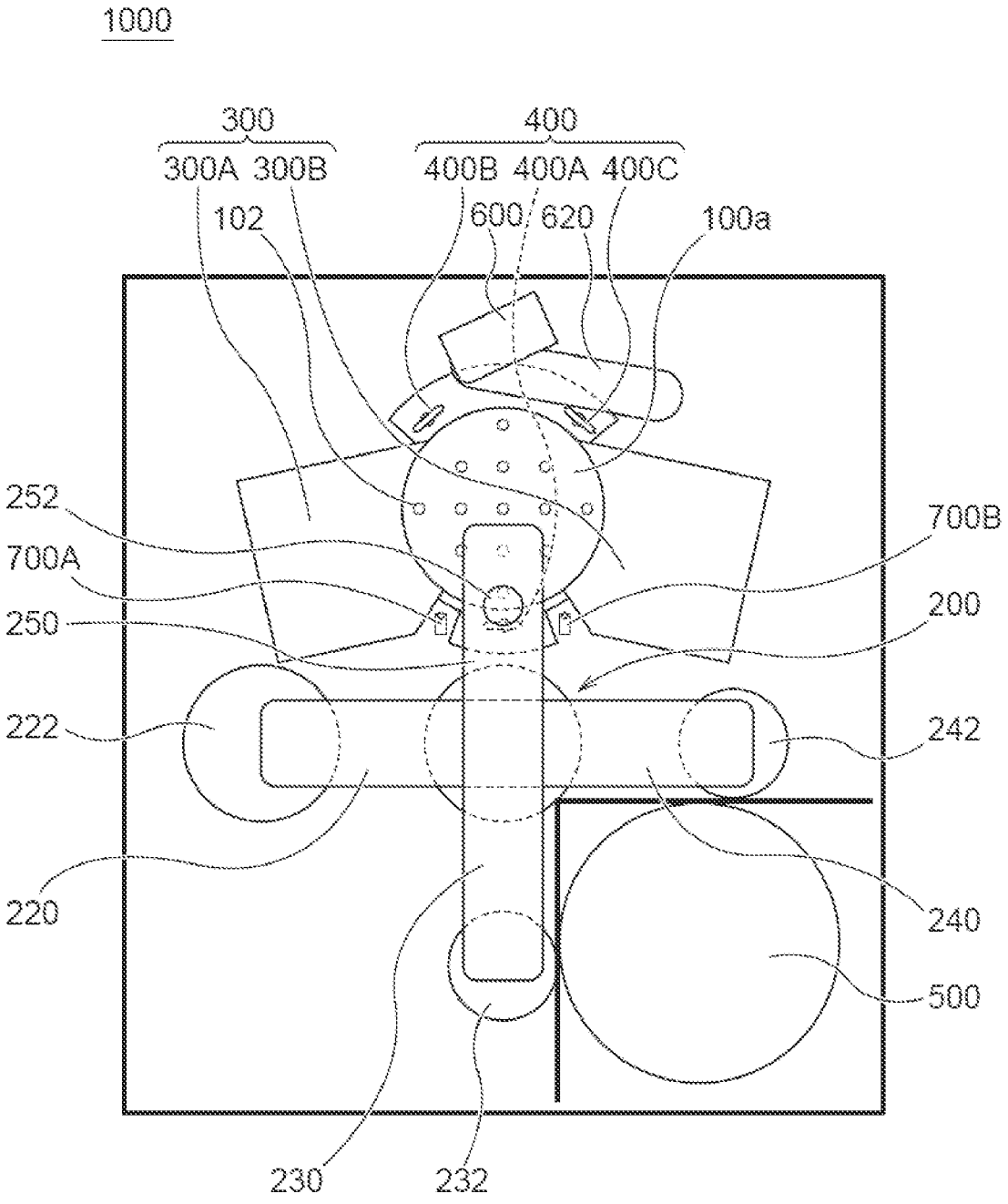
FIG. 2 is a plan view schematically illustrating the overall configuration of the substrate processing apparatus according to one embodiment.

FIG. 1 is a perspective view schematically illustrating an overall configuration of a substrate processing apparatus according to one embodiment. FIG. 2 is a plan view schematically illustrating the overall configuration of the substrate processing apparatus according to one embodiment. A substrate processing apparatus 1000 illustrated in FIG. 1 and FIG. 2 includes a table 100, a multi-axis arm 200, supporting members 300A and 300B, a diameter measuring instrument 400 (centering mechanisms 400A, 400B, and 400C), a dresser 500, a film thickness measuring instrument (an ending point detector) 600, and cleaning nozzles 700A and 700B.

<Table>

The table 100 is a member for supporting a substrate WF as a process target. In one embodiment, the table 100 has a support surface 100*a* for supporting the substrate WF and is configured to be rotatable by a driving mechanism, such as a motor, (not illustrated). The support surface 100*a* has a plurality of holes 102. The table 100 is configured to be able to vacuum suction the substrate WF via the holes 102.

<Multi-Axis Arm>

Figure 3:
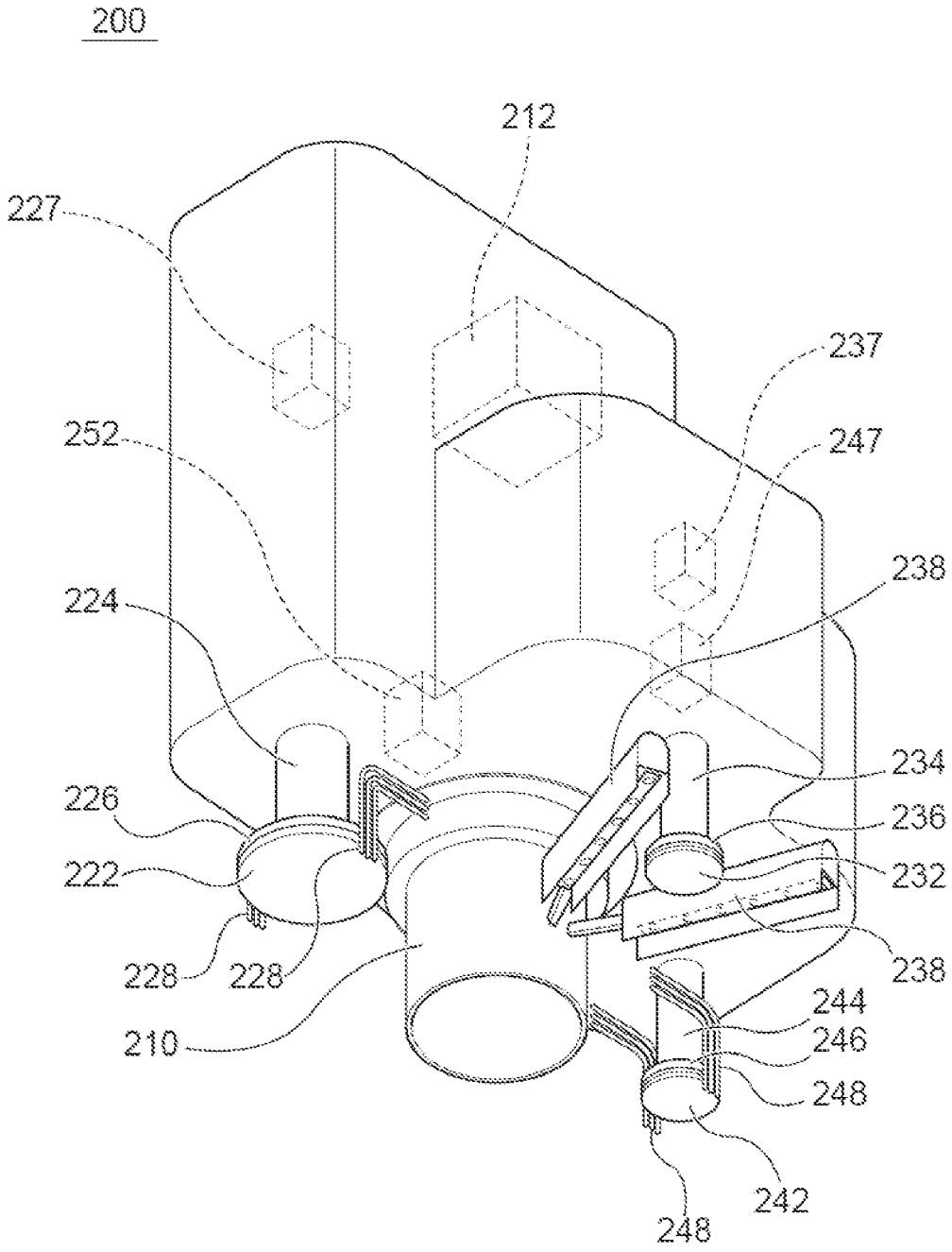
FIG. 3 is a perspective view schematically illustrating a multi-axis arm according to one embodiment.

FIG. 3 is a perspective view schematically illustrating the multi-axis arm according to one embodiment. As illustrated in FIG. 2 and FIG. 3, the multi-axis arm 200 is a member for holding a plurality of processing tools for performing various kinds of processes on the substrate WF supported by the table 100, and is arranged adjacent to the table 100. The multi-axis arm 200 according to the embodiment is configured to hold a polishing pad 222 with a large diameter for polishing the substrate WF, a cleaning tool 232 for cleaning the substrate WF, a polishing pad 242 with a small diameter for final polishing of the substrate WF, and a photographing member (a camera) 252 for measuring a diameter of the substrate WF.

Specifically, the multi-axis arm 200 includes a swing shaft 210 that extends in a direction (a height direction) perpendicular to the substrate WF, a rotation drive mechanism 212, such as a motor, that rotatably drives the swing shaft 210, and a first arm 220, a second arm 230, a third arm 240, and a fourth arm 250 supported by the swing shaft 210 and radially arranged in a peripheral area of the swing shaft 210. The first arm 220 includes a rotation shaft 224 extending in the height direction, and the rotation shaft 224 has a distal end where a pad holder 226 is mounted. The pad holder 226 holds the polishing pad 222 with a large diameter. The pad holder 226 is elevatable in the height direction with respect to the substrate WF by an elevating mechanism 227 configured of a driving mechanism, such as an air cylinder. The second arm 230 includes a rotation shaft 234 extending in the height direction, and the rotation shaft 234 has a distal end where a cleaning tool holder 236 is mounted. The cleaning tool holder 236 holds the cleaning tool 232. The cleaning tool holder 236 is elevatable in the height direction with respect to the substrate WF by an elevating mechanism 237 configured of a driving mechanism, such as an air cylinder. The third arm 240 includes a rotation shaft 244 extending in the height direction, and the rotation shaft 244 has a distal end where a pad holder 246 is mounted. The pad holder 246 holds the polishing pad 242 with a small diameter. The pad holder 246 is elevatable in the height direction with respect to the substrate WF by an elevating mechanism 247 configured of a driving mechanism, such as an air cylinder. The fourth arm 250 holds the photographing member 252.

The first arm 220 is configured to further hold nozzles 228 together with the polishing pad 222. The nozzles 228 are disposed at both sides in a swing direction of the polishing pad 222 by sandwiching the polishing pad 222, and are configured to discharge polishing liquid or cleaning water to the substrate WF. The second arm 230 is configured to further hold atomizers 238 together with the cleaning tool 232. The atomizers 238 are disposed at both sides in a swing direction of the cleaning tool 232 by sandwiching the cleaning tool 232, and are configured to discharge liquid, such as pure water, to the substrate WF. The third arm 240 is configured to further hold nozzles 248 together with the polishing pad 242. The nozzles 248 are disposed at both sides in a swing direction of the polishing pad 242 by sandwiching the polishing pad 242, and are configured to discharge polishing liquid or cleaning water to the substrate WF.

As illustrated in FIG. 2, the first arm 220, the second arm 230, the third arm 240, and the fourth arm 250 shift by 90 degrees counter-clockwise in plan view and radially extend in the peripheral area of the swing shaft 210 in the embodiment. The rotation drive mechanism 212 rotatably drives the swing shaft 210 to ensure moving any of the polishing pad 222 with a large diameter, the cleaning tool 232, the polishing pad 242 with a small diameter, and the photographing member 252 to above the substrate WF. The rotation drive mechanism 212 also rotatably drives the swing shaft 210 to ensure moving the polishing pad 222 or the polishing pad 242 to above the dresser 500. The rotation drive mechanism 212 also rotatably drives the swing shaft 210 alternately clockwise and counter-clockwise to have a function of a swing mechanism that swings the first arm 220, the second arm 230, the third arm 240, and the fourth arm 250. Specifically, the rotation drive mechanism 212 rotatably drives the swing shaft 210 alternately clockwise and counter-clockwise in a state where the polishing pad 222, the cleaning tool 232, or the polishing pad 242 is located above the substrate WF to ensure swinging the polishing pad 222 (the pad holder 226), the cleaning tool 232 (the cleaning tool holder 236), or the polishing pad 242 (the pad holder 246) with respect to the substrate WF. While the embodiment illustrates the example where the polishing pad 222, the cleaning tool 232, or the polishing pad 242 are pivotally swung in a radial direction of the substrate WF, that is, reciprocated along a circular arc by the rotation drive mechanism 212, it is not limited to this. For example, the swing mechanism may have a configuration where the polishing pad 222, the cleaning tool 232, or the polishing pad 242 is swung straight in the radial direction of the substrate, that is, reciprocated along a straight line.

The multi-axis arm 200 includes a rotation drive mechanism, such as a motor, (not illustrated) for rotating the rotation shafts 224, 234, and 244, and this ensures rotating the polishing pad 222, the cleaning tool 232, and the polishing pad 242 about the rotation shafts 224, 234, and 244 as axes. For example, when the polishing pad 222 is located above the substrate WF, the substrate processing apparatus 1000 is configured to polish the substrate WF by rotating the table 100 as well as rotating the polishing pad 222, and swinging the polishing pad 222 using the rotation drive mechanism 212 while the elevating mechanism 227 pressing the polishing pad 222 against the substrate WF.

<Supporting Member>

As illustrated in FIG. 1 and FIG. 2, the substrate processing apparatus 1000 includes the first supporting member 300A disposed in a swing path of the polishing pad 222 outside the table 100 and the second supporting member 300B disposed in a swing path of the polishing pad 222 at an opposite side of the table 100 from the first supporting member 300A. The first supporting member 300A and the second supporting member 300B are line-symmetric with the substrate WF interposed therebetween. In view of this, the first supporting member 300A and the second supporting member 300B are together described as a supporting member 300 in the following. While the following describes a function of the supporting member 300 when the polishing pad 222 with a large diameter is swung with respect to the substrate WF as an example, the same applies to the cleaning tool 232 or the polishing pad 242 with a small diameter.

The supporting member 300 is a member for supporting the polishing pad 222 swung to outside the table 100 by the rotation of the swing shaft 210. That is, the substrate processing apparatus 1000 is configured to uniformly polish a surface to be polished of the substrate WF by swinging the polishing pad 222 (causing the polishing pad 222 to overhang) to move out to an outside of the substrate WF when the substrate WF is polished. Here, when the polishing pad 222 is caused to overhang, a pressure of the polishing pad 222 may concentrate on a peripheral edge portion of the substrate WF due to various factors, such as tilting of the pad holder 226, to possibly fail to uniformly polish the surface to be polished of the substrate WF. Therefore, the substrate processing apparatus 1000 of the embodiment is provided with the supporting member 300 for supporting the polishing pad 222 overhanging outside the substrate WF at both the sides of the table 100.

Figure 4:
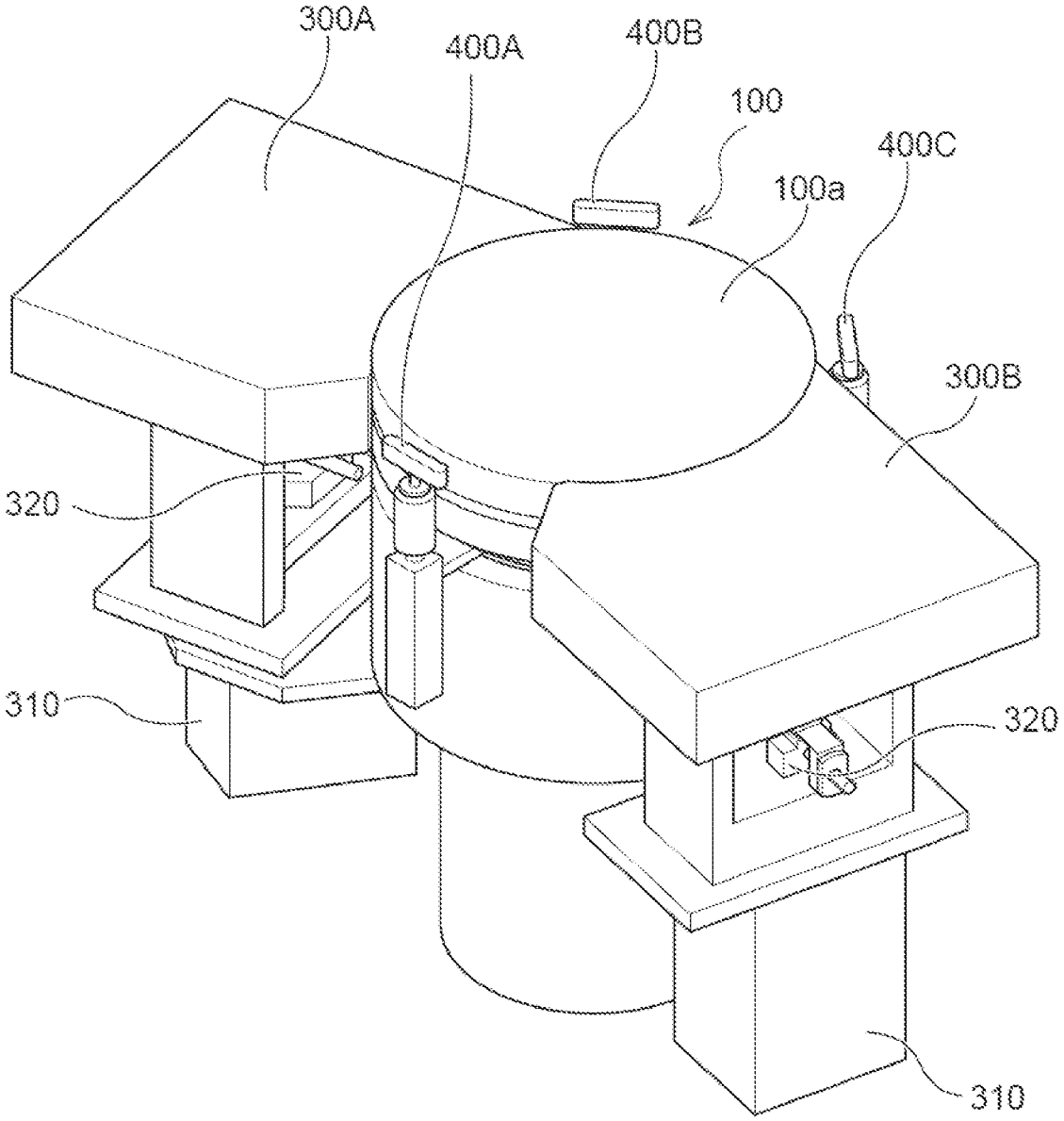
FIG. 4 is a perspective view schematically illustrating a table and a supporting member according to one embodiment.
Figure 5:
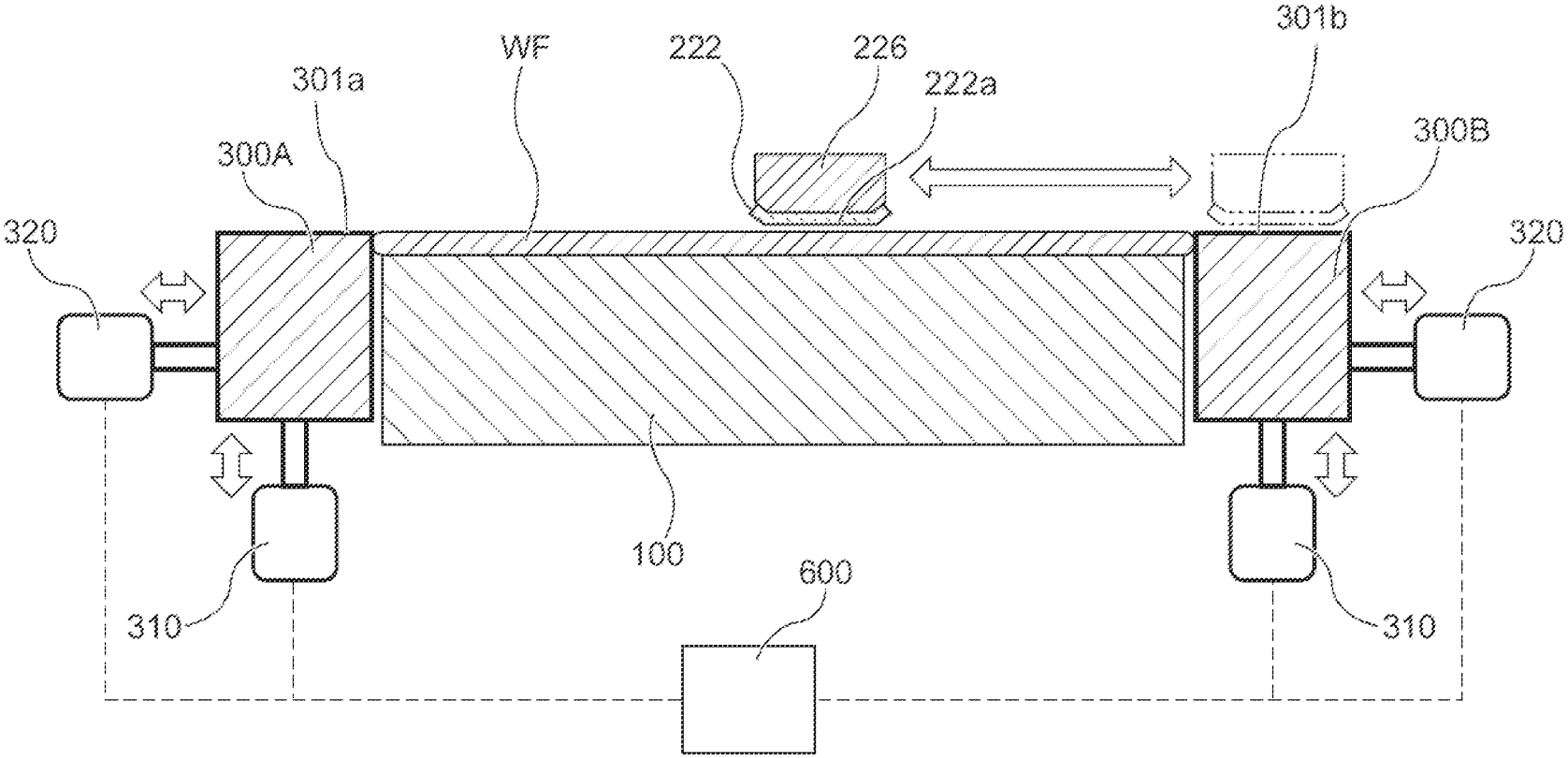
FIG. 5 is a side view schematically illustrating the table and the supporting member according to one embodiment.

FIG. 4 is a perspective view schematically illustrating the table and the supporting member according to one embodiment. FIG. 5 is a side view schematically illustrating the table and the supporting member according to one embodiment. As illustrated in FIG. 5, the supporting member 300 (the first supporting member 300A and the second supporting member 300B, respectively) has support surfaces 301*a* and 301*b* that can support a whole polishing surface 222*a*, which is brought into contact with the substrate WF, of the polishing pad 222. That is, since the support surfaces 301*a* and 301*b* each have a size larger than a size of the polishing surface 222*a* of the polishing pad 222, the whole polishing surface 222*a* is supported by the support surfaces 301*a* and 301*b* even when the polishing pad 222 overhangs completely outside the substrate WF. In view of this, the polishing pad 222 has the whole polishing surface 222*a* brought into contact with and supported by the substrate WF when the polishing pad 222 swings above the substrate WF and has the whole polishing surface 222*a* supported by the supporting member 300 also when the polishing pad 222 swings to outside the table 100 in the embodiment. Therefore, the polishing pad 222 does not protrude out of a region of the surface to be polished of the substrate WF and the support surfaces 301*a* and 301*b* during swinging.

<Film Thickness Measuring Instrument>

Figure 6:
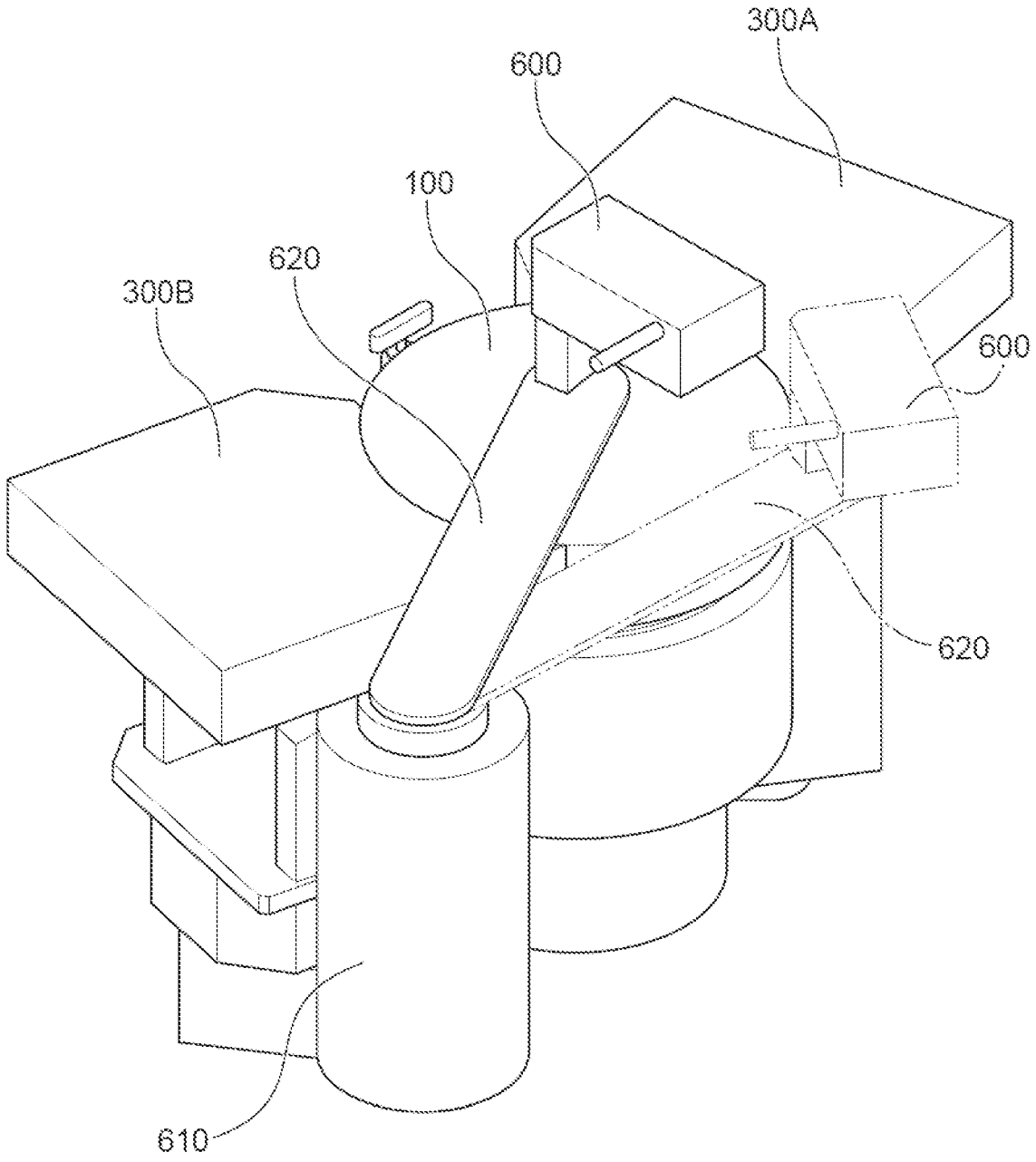
FIG. 6 is a perspective view schematically illustrating the table, the supporting member, and a film thickness measuring instrument according to one embodiment.

As illustrated in FIG. 1 and FIG. 2, the substrate processing apparatus 1000 includes the film thickness measuring instrument 600 for measuring a film thickness profile of the surface to be polished of the substrate WF while polishing the substrate WF. The film thickness measuring instrument 600 can be configured of a various sensor, such as an eddy current sensor or an optical sensor. FIG. 6 is a perspective view schematically illustrating the table, the supporting member, and the film thickness measuring instrument according to one embodiment. As illustrated in FIG. 6, a rotation shaft 610 extending in the height direction is disposed adjacent to the table 100. The rotation shaft 610 is rotatable about an axis of the rotation shaft 610 by a rotation drive mechanism, such as a motor, (not illustrated). The rotation shaft 610 includes a swing arm 620, and the film thickness measuring instrument 600 is mounted on a distal end of the swing arm 620. The film thickness measuring instrument 600 is configured to pivotally swing about the axis of the rotation shaft 610 by the rotation of the rotation shaft 610. Specifically, the film thickness measuring instrument 600 can swing along the radial direction of the substrate WF by the rotation of the rotation shaft 610 during polishing of the substrate WF. The film thickness measuring instrument 600 is configured to swing to a position moved away from above the substrate WF as illustrated by the dashed line in FIG. 6 while the polishing pad 222 is swinging above the substrate WF, and to swing above the substrate WF as illustrated by the solid line in FIG. 6 while the polishing pad 222 is not swinging above the substrate WF. That is, the film thickness measuring instrument 600 is configured to swing above the substrate WF with a timing where it does not interfere with the polishing pad 222 swinging above the substrate WF, and can measure the film thickness profile of the substrate WF polished by the polishing pad 222 over time. The film thickness measuring instrument 600 can detect an ending point of the polishing of the substrate WF when the measured film thickness profile of the substrate WF obtains a desired film thickness profile.

<Substrate Thickness Measuring Instrument>

Figure 7:
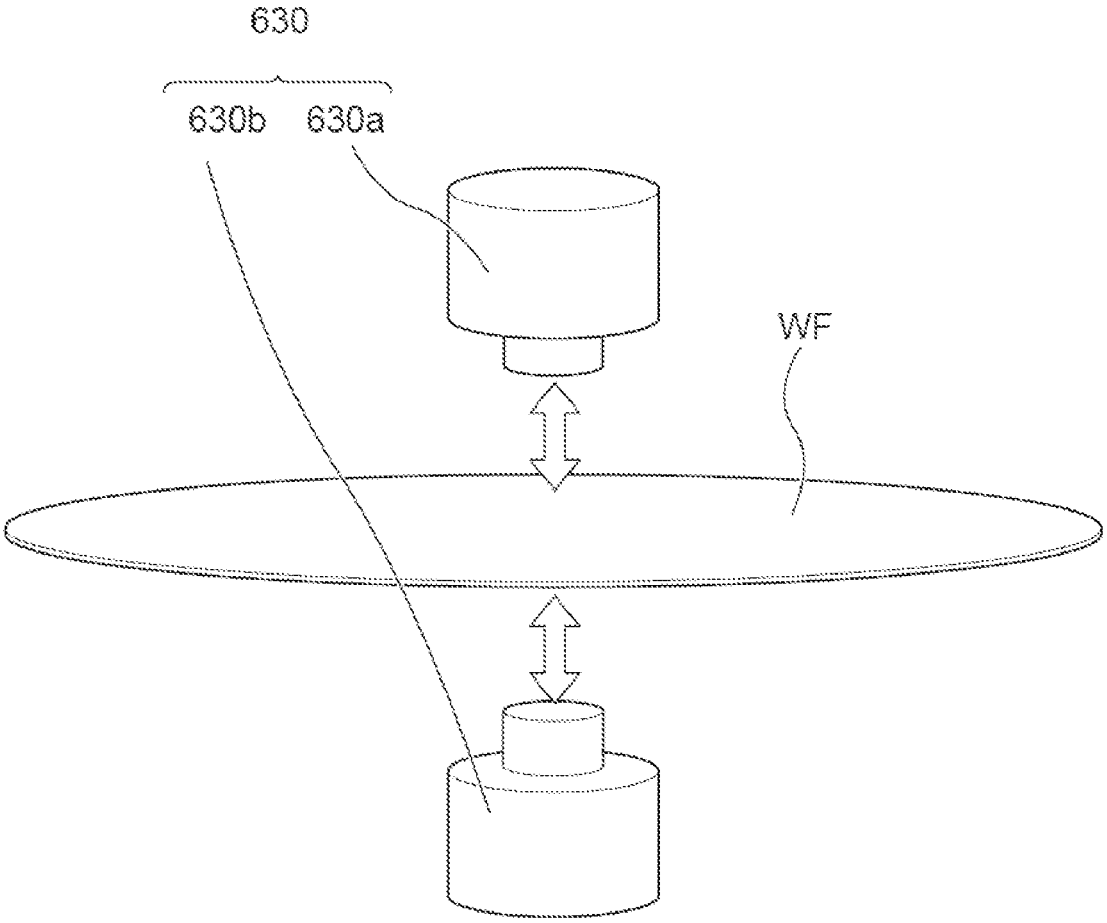
FIG. 7 is a perspective view schematically illustrating a substrate thickness measuring instrument according to one embodiment.

FIG. 7 is a perspective view schematically illustrating a substrate thickness measuring instrument according to one embodiment. The substrate processing apparatus 1000 includes a substrate thickness measuring instrument 630 for measuring a thickness of the substrate WF. The substrate thickness measuring instrument 630 is installed between, for example, a Front Opening Unified Pod (FOUP) and the table 100, and can measure a thickness of the substrate WF taken out of the FOUP and installed on the table 100. The substrate thickness measuring instrument 630 can be configured of, for example, a laser length measuring device. The substrate thickness measuring instrument 630 includes a first substrate thickness measuring member 630*a* disposed on a front surface side of the substrate WF and a second substrate thickness measuring member 630*b* disposed on a back surface side of the substrate WF. The first substrate thickness measuring member 630*a* radiates a laser beam toward the front surface of the substrate WF and receives the reflected laser beam. The second substrate thickness measuring member 630*b* radiates a laser beam toward the back surface of the substrate WF and receives the reflected laser beam. The substrate thickness measuring instrument 630 is configured to measure the thickness of the substrate WF based on the laser beam received by the first substrate thickness measuring member 630*a* and the laser beam received by the second substrate thickness measuring member 630*b*.

<Driving Mechanism>

As illustrated in FIG. 4 and FIG. 5, the substrate processing apparatus 1000 includes the driving mechanism 310 for adjusting a height of the supporting member 300. The driving mechanism 310 can be configured of various known mechanisms, such as a motor and a ball screw, and can adjust the supporting member 300 (the support surface 301*a* and the support surface 301*b*) to have a desired height. The substrate processing apparatus 1000 includes the driving mechanism 320 for adjusting a distance of the supporting member 300 to the substrate WF by adjusting a position in a horizontal direction of the supporting member 300, that is, a position along the radial direction of the substrate WF supported by the table 100. The driving mechanism 320 can be configured of various mechanisms, such as a motor and a ball screw.

The driving mechanism 310 can adjust the height of the supporting member 300 based on the thickness of the substrate WF measured by the substrate thickness measuring instrument 630 when the substrate WF is installed on the table 100 as an initial adjustment of the supporting member 300. For example, the driving mechanism 310 can adjust the height of the supporting member 300 such that the surface to be polished of the substrate WF and the supporting member 300 (the support surface 301*a* and the support surface 301*b*) have the same heights. Not limited to this, but the driving mechanism 310 can adjust the supporting member 300 to have a desired height, for example, higher by a predetermined value and lower by a predetermined value than the surface to be polished of the substrate WF installed on the table 100.

The driving mechanism 320 can adjust the distance of the supporting member 300 to the substrate WF installed on the table 100 based on a diameter of the substrate WF obtained by a method described later as the initial adjustment of the supporting member 300. For example, in order to uniformly polish the surface to be polished of the substrate WF, it is preferred that there is no gap between the substrate WF and the supporting member 300. However, the substrate WF rotates in association with the rotation of the table 100 during the polishing process, whereas the supporting member 300 does not rotate, and therefore, it is not possible to bring the supporting member 300 into contact with the outer peripheral portion of the substrate WF. Therefore, the driving mechanism 320 can arrange the supporting member 300 at a position closest to the outer peripheral portion of the substrate WF insofar as the supporting member 300 does not contact the outer peripheral portion of the substrate WF based on the obtained diameter of the substrate WF.

In addition to this, the driving mechanisms 310 and 320 can adjust at least one of the height and the distance to the substrate WF of the supporting member 300 along the radial direction of the substrate WF in accordance with a state of the surface to be polished of the substrate WF while polishing the substrate WF. That is, as described above, even though the supporting member 300 is adjusted to have a desired height and to be at a desired position in the horizontal direction in the initial adjustment, the film thickness profile during polishing can be different by each substrate WF depending on differences of various polishing conditions. Therefore, in the embodiment, the driving mechanisms 310 and 320 are configured to adjust a position in the height direction and a position in the horizontal direction of the supporting member 300 in accordance with the film thickness profile of the substrate WF obtained by the film thickness measuring instrument 600 during polishing of the substrate WF.

Figure 8:
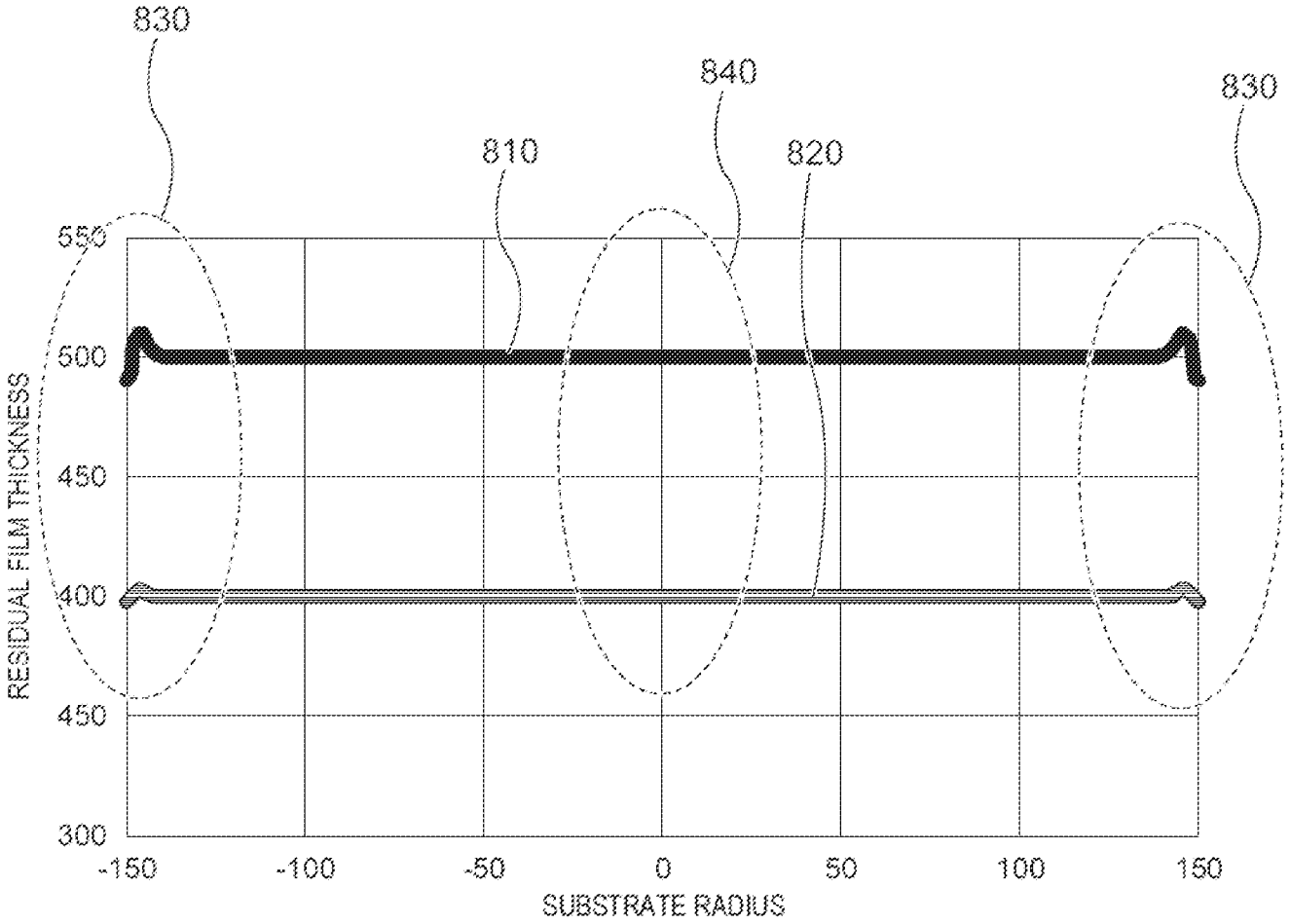
FIG. 8 is a drawing schematically illustrating film thickness profiles of a substrate according to one embodiment.

This will be described by referring to FIG. 8. FIG. 8 is a drawing schematically illustrating film thickness profiles of the substrate according to one embodiment. FIG. 8 illustrates a film thickness profile 810 of the substrate WF during polishing and a film thickness profile 820 of the substrate WF after the position in the height direction and the position in the horizontal direction of the supporting member 300 are adjusted in accordance with the film thickness profile 810. When the substrate WF is polished while the polishing pad 222 is swung as in the embodiment, there is a case where the polishing results insufficient at an edge portion of the substrate WF to locally leave a thick residual film as illustrated with the film thickness profile 810 even when the polishing pad 222 is caused to overhang. Thus, when a film thickness 830 at the edge portion of the substrate WF is thicker than a film thickness 840 in a center portion in the film thickness profile 810 measured by the film thickness measuring instrument 600, the driving mechanisms 310 and 320 are configured to lower the height of the supporting member 300 or widen the distance of the supporting member 300 to the substrate WF. Note that the driving mechanisms 310 and 320 may lower the height of the supporting member 300 and widen the distance of the supporting member 300 to the substrate WF. This applies large pressing force of the polishing pad 222 onto the edge portion of the substrate WF, thereby ensuring an increased polishing rate of the edge portion. As a result, the thickness of the local residual film on the edge portion of the substrate WF can be flattened as illustrated with the film thickness profile 820. Thus, the embodiment ensures improved polishing uniformity of the surface to be polished appropriately in accordance with the state (the film thickness profile) of the surface to be polished of the substrate WF during polishing.

<Centering Mechanism and Diameter Measuring Instrument>

As illustrated in FIG. 1 and FIG. 2, the substrate processing apparatus 1000 includes the diameter measuring instrument 400 for measuring a diameter of the substrate WF. The diameter measuring instrument 400 includes at least three centering mechanisms 400A, 400B, and 400C for pushing the substrate WF supported by the table 100 in a center direction of the table 100 to position the substrate WF in the embodiment. The centering mechanisms 400A, 400B, and 400C are arranged with appropriate intervals in a peripheral area of the table 100. The diameter measuring instrument 400 is configured to calculate the diameter of the substrate WF based on the result of the positioning of the substrate WF by the centering mechanisms 400A, 400B, and 400C.

Figure 9:
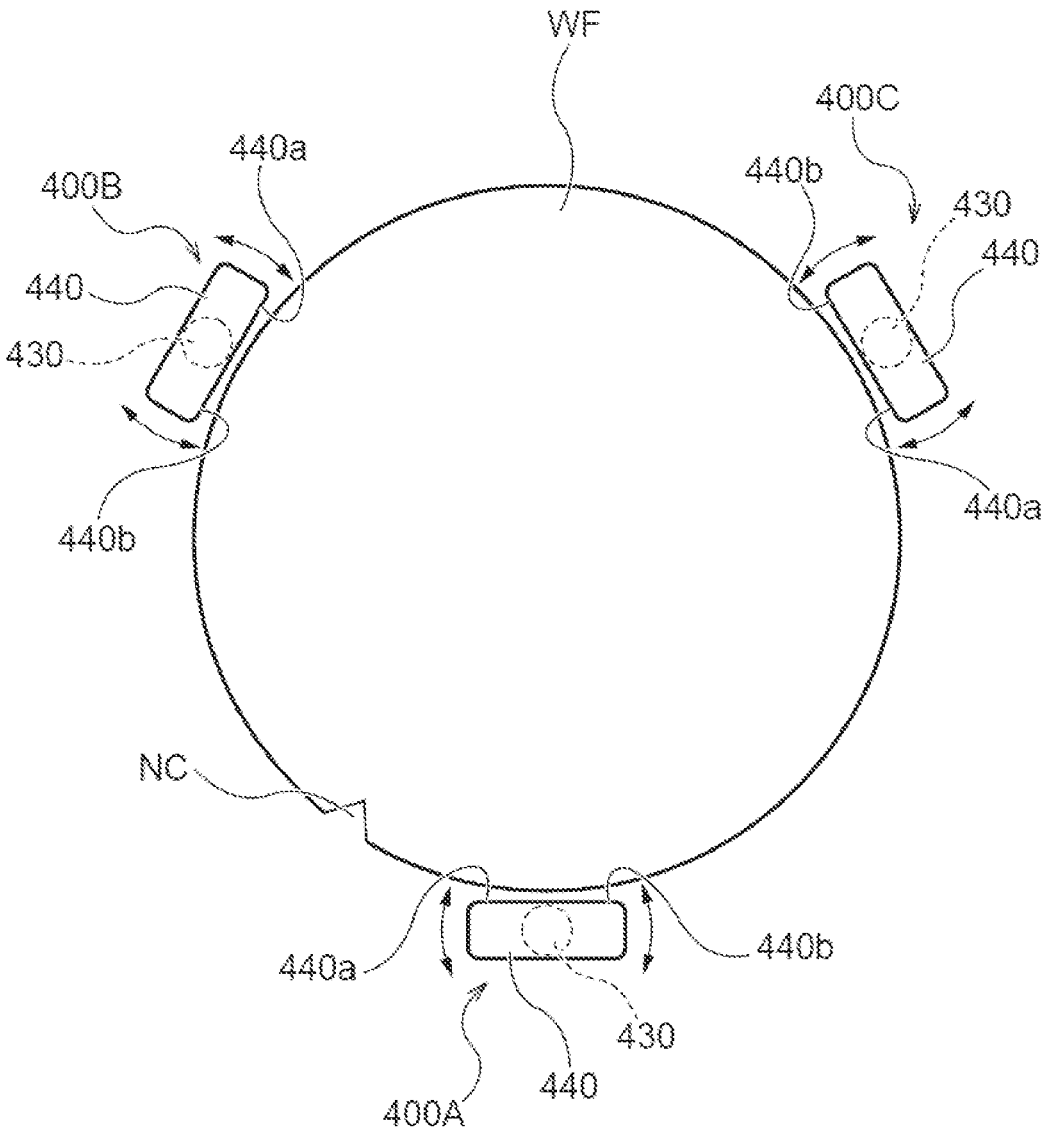
FIG. 9 is a plan view schematically illustrating a centering mechanism according to one embodiment.

This will be described in detail by referring to FIG. 9. FIG. 9 is a plan view schematically illustrating the centering mechanism according to one embodiment. As illustrated in FIG. 9, the centering mechanisms 400A, 400B, and 400C each include a rotation shaft 430 that extends in the height direction and a centering member 440 mounted on the rotation shaft 430. The rotation shaft 430 is configured to be rotatable by a rotation drive mechanism, such as a motor, (not illustrated). The centering member 440 is a rod-shaped member mounted on the rotation shaft 430 at a same height position as the substrate WF, and extends to both sides of the rotation shaft 430. The centering member 440 includes a first contact portion 440*a* brought into contact with the substrate WF when the rotation shaft 430 rotates in a first direction (for example, a clockwise direction) and a second contact portion 440*b* brought into contact with the substrate WF when the rotation shaft 430 rotates in a second direction (for example, a counter-clockwise direction) opposite of the first direction.

The diameter measuring instrument 400 is configured to calculate the diameter of the substrate WF based on a rotation angle in the first direction of the centering member 440 or a rotation angle in the second direction of the centering member 440. That is, the centering mechanisms 400A, 400B, and 400C each rotate the rotation shaft 430 in the first direction at the same timing to push the substrate WF with the first contact portion 440*a* once the substrate WF is installed on the table 100. Then, the first contact portion 440*a* of the centering member closest to the substrate WF among three centering members 440 pushes the substrate WF in the center direction of the table 100. Afterwards, the first contact portions 440*a* of the remaining centering members 440 also sequentially push the substrate WF in the center direction of the table 100, and as a result, the substrate WF is pushed in the center direction of the table 100 from three directions. After the first contact portions 440*a* of three centering members 440 equally push the substrate WF, the substrate WF is centered at a center position of the table 100 and is positioned. The positioning of the substrate WF done by rotating the rotation shafts 430 in the first direction is hereinafter referred to as a "first positioning."

Here, as illustrated in FIG. 9, there is a notch (a cutout) NC on an outer peripheral portion of the substrate WF. When any of the first contact portions 440*a* of three centering members 440 pushes the notch NC, the positioning of the substrate WF is displaced from the center of the table 100 and the calculation of the diameter of the substrate WF is not accurately performed. Therefore, in the embodiment, after the first positioning is performed, the rotation shafts 430 are rotated in the second direction to push the substrate WF with the second contact portions 440*b*, and thus, the substrate WF can be centered at the center position of the table 100 and positioned. The positioning of the substrate WF done by rotating the rotation shafts 430 in the second direction is hereinafter referred to as a "second positioning."

Since the positioning of the substrate WF is displaced when any of the second contact portions 440*b* pushes the notch NC of the substrate WF in the second positioning, performing the first positioning again ensures centering the substrate WF at the center position of the table 100. This is because while any one of the first contact portion 440*a* and the second contact portion 440*b* possibly pushes the notch NC, not both of them push the notch NC. The embodiment ensures reliably positioning the substrate WF at the center position of the table 100 even when there is the notch NC on the outer peripheral portion of the substrate WF.

The diameter measuring instrument 400 has a reference table for correlating the rotation angle in the first direction and the rotation angle in the second direction of the rotation shaft 430 with the diameter of the substrate WF. That is, even though the substrate WF has a predetermined size determined by a specification, the diameter of the substrate WF has a tolerance (a variation) in practice. Therefore, the diameter measuring instrument 400 stores a preliminarily made reference table of a correlation relation between the rotation angles of the rotation shaft 430 and the diameters of the substrate WF based, for example, on the rotation angle in the first direction and the rotation angle in the second direction of the rotation shaft 430 when the first contact portion 440*a* and the second contact portion 440*b* are pushed against the table 100 with a known diameter. The diameter measuring instrument 400 can calculate the diameter of the substrate WF by deriving the diameters corresponding to the rotation angle in the first direction and the rotation angle in the second direction of the rotation shaft 430 when the substrate WF is positioned based on the stored reference table.

Specifically, the diameter measuring instrument 400 calculates a diameter (a first diameter) of the substrate WF based on the rotation angle in the first direction of the rotation shaft 430 when the first positioning is performed and the reference table. Afterwards, the diameter measuring instrument 400 calculates a diameter (a second diameter) of the substrate WF based on the rotation angle in the second direction of the rotation shaft 430 when the second positioning is performed and the reference table. When a comparison between the first diameter and the second diameter results that both of them are equal, the diameter measuring instrument 400 outputs any of the first diameter or the second diameter as the diameter of the substrate WF as it is considered that the notch NC of the substrate WF is not pushed in performing both the first positioning and the second positioning. On one hand, when the second diameter is larger than the first diameter, the diameter measuring instrument 400 outputs the second diameter as the diameter of the substrate WF as it is considered that the notch NC of the substrate WF is pushed in performing the first positioning. On the other hand, when the first diameter is larger than the second diameter, the diameter measuring instrument 400 performs the first positioning again and outputs the first diameter as the diameter of the substrate WF as it is considered that the notch NC of the substrate WF is pushed in performing the second positioning. Thus, the diameter measuring instrument 400 can calculate the diameter of the substrate WF using the rotation angle of when the notch NC is not pushed among the rotation angle in the first direction and the rotation angle in the second direction of the rotation shaft 430.

Figure 10:
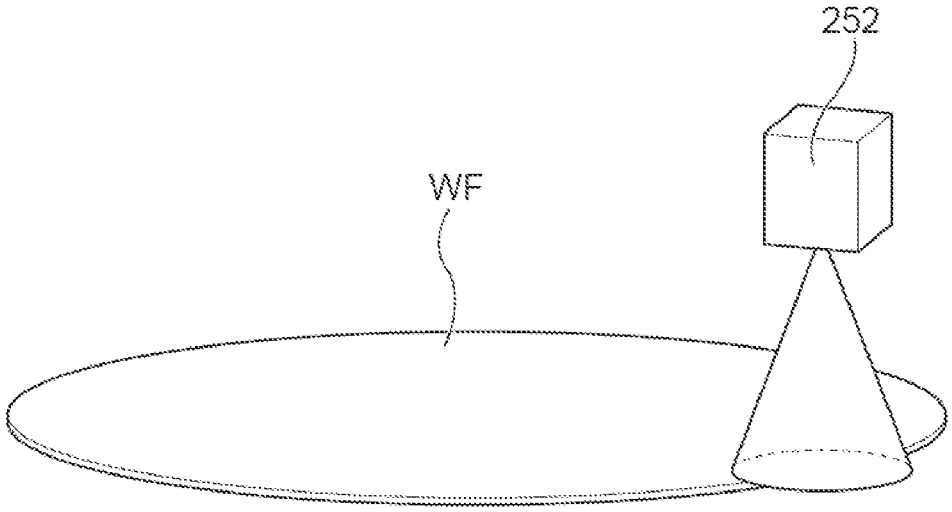
FIG. 10 is a side view schematically illustrating a diameter measuring instrument according to one embodiment.

While the above-described embodiment has illustrated the example where the diameter measuring instrument 400 includes the centering mechanisms 400A, 400B, and 400C, it is not limited to this. The diameter measuring instrument 400 may include the above-described photographing member (the camera) 252. FIG. 10 is a side view schematically illustrating the diameter measuring instrument according to one embodiment. As illustrated in FIG. 2 and FIG. 10, the photographing member 252 is arranged at a position where an image of the outer peripheral portion of the substrate WF can be taken. The photographing member 252 can take the image of the outer peripheral portion of the substrate WF and calculate the diameter of the substrate WF from a curvature of the outer peripheral portion of the substrate WF in the taken image.

<Dresser>

As illustrated in FIG. 1 and FIG. 2, the dresser 500 is arranged in a turning path of the polishing pads 222 and 242 by the rotation of the swing shaft 210. The dresser 500 has a surface on which diamond particles and the like are strongly electrodeposited and is a member for toothing (dressing) the polishing pads 222 and 242. The dresser 500 is configured to rotate by a rotation drive mechanism, such as a motor, (not illustrated). The surface of the dresser 500 can be supplied with pure water from a nozzle (not illustrated). The substrate processing apparatus 1000 rotates the dresser 500 while the pure water is supplied to the dresser 500 from the nozzle, and rotates the polishing pads 222 and 242 and swings them with respect to the dresser 500 while pressing them onto the dresser 500. This files the polishing pads 222 and 242 with the dresser 500 to dress the polishing surfaces of the polishing pads 222 and 242.

<Cleaning Nozzle>

As illustrated in FIG. 1 and FIG. 2, the cleaning nozzles 700A and 700B are arranged adjacent to the table 100. The cleaning nozzle 700A is configured supply cleaning liquid, such as pure water, to a gap between the table 100 and the supporting member 300A. This ensures washing away polishing dust and the like entered between the table 100 and the supporting member 300A. The cleaning nozzle 700B is configured to supply cleaning liquid, such as pure water, to a gap between the table 100 and the supporting member 300B. This ensures washing away polishing dust and the like entered between the table 100 and the supporting member 300B.

<Flowchart>

Figure 11:
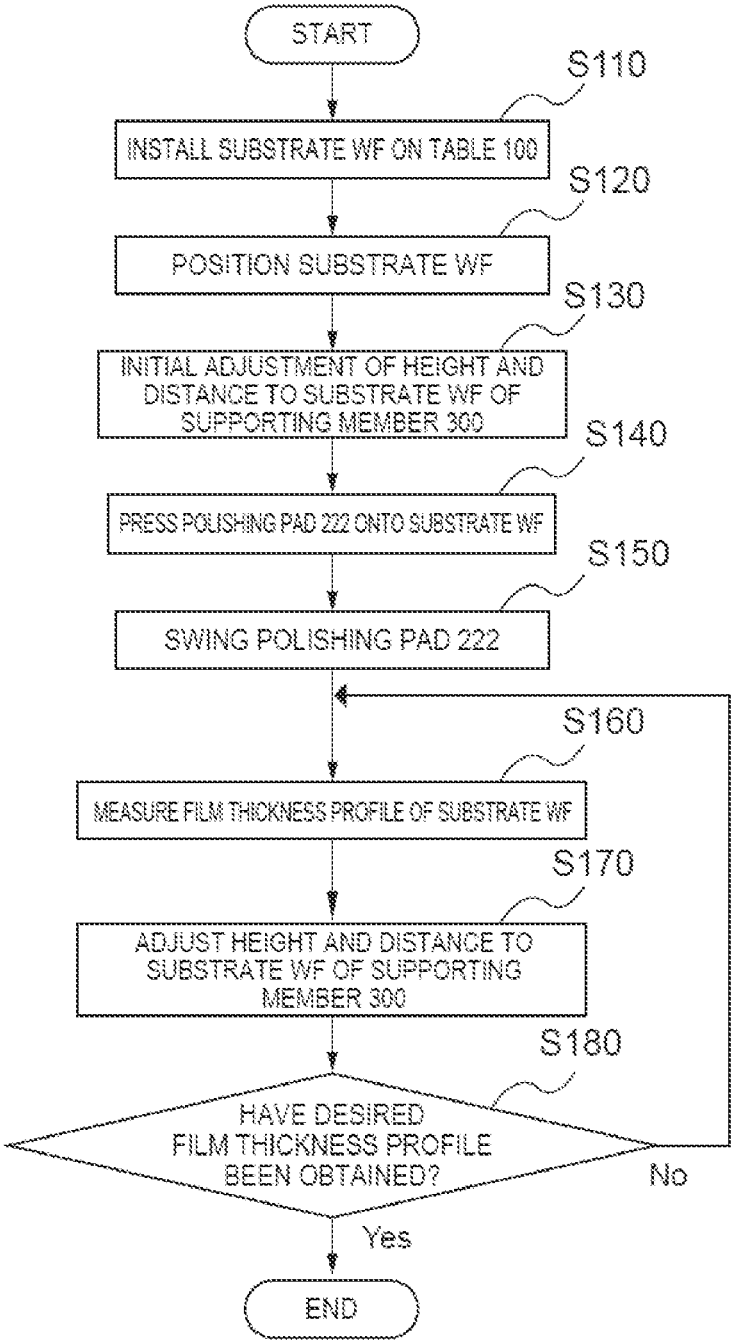
FIG. 11 is a flowchart illustrating a substrate processing method according to one embodiment.

Next, a procedure of a substrate processing method including the adjustment of the height position and the horizontal position of the supporting member 300 according to the embodiment will be described. FIG. 11 is a flowchart illustrating the substrate processing method according to one embodiment. As illustrated in FIG. 11, the substrate processing method first installs the substrate WF on the table 100 (an installing step S110). Subsequently, the substrate processing method positions the substrate WF using the centering mechanisms 400A, 400B, and 400C (a positioning step S120). Subsequently, the substrate processing method performs the initial adjustment of the height and the distance to the substrate WF of the supporting member 300 (an initial adjusting step S130). The initial adjusting step S130, for example, can adjust the height of the supporting member 300 based on the thickness of the substrate WF measured by the substrate thickness measuring instrument 630 in advance and adjust the position in the horizontal direction of the supporting member 300 based on the diameter of the substrate WF obtained by the positioning step S120.

Subsequently, the substrate processing method rotates the table 100 and presses the polishing pad 222 against the substrate WF while rotating the polishing pad 222 (a pressing step S140). Subsequently, the substrate processing method swings the polishing pad 222 (a swinging step S150). Subsequently, the substrate processing method measures the film thickness profile of the surface to be polished of the substrate WF with the film thickness measuring instrument 600 while polishing the substrate WF (a film thickness measuring step S160). Subsequently, the substrate processing method adjusts at least one of the height and the distance to the substrate WF of the supporting member 300 while polishing the substrate WF with the driving mechanisms 310 and 320 (an adjusting step S170). For example, the adjusting step S170 can adjust at least one of the height and the distance to the substrate WF of the supporting member 300 in accordance with the film thickness profile measured in the film thickness measuring step S160. In one example, the adjusting step S170 can lower the height of the supporting member 300 or widen the distance to the substrate WF of the supporting member 300 when the film thickness 830 of the edge portion of the substrate WF is thicker than the film thickness 840 in the center portion in the film thickness profile measured in the film thickness measuring step S160 as illustrated with the film thickness profile 810 in FIG. 8.

Subsequently, the substrate processing method determines whether the film thickness profile measured in the film thickness measuring step S160 is the desired film thickness profile or not (a determination step S180). The substrate processing method returns to the film thickness measuring step S160 and repeats the process when it is determined that the desired film thickness profile is not obtained (No at the determination step S180). On the other hand, the substrate processing method terminates the polishing process when it is determined that the desired film thickness profile is obtained (Yes at the determination step S180).

According to the embodiment, for example, as illustrated with the film thickness profile 820 in FIG. 8, the local residual film thickness on the edge portion of the substrate WF can be flattened. Thus, the embodiment can improve the polishing uniformity of the surface to be polished appropriately in accordance with the state (the film thickness profile) of the surface to be polished of the substrate WF during polishing.

<Modification of Supporting Member>

Figure 12:
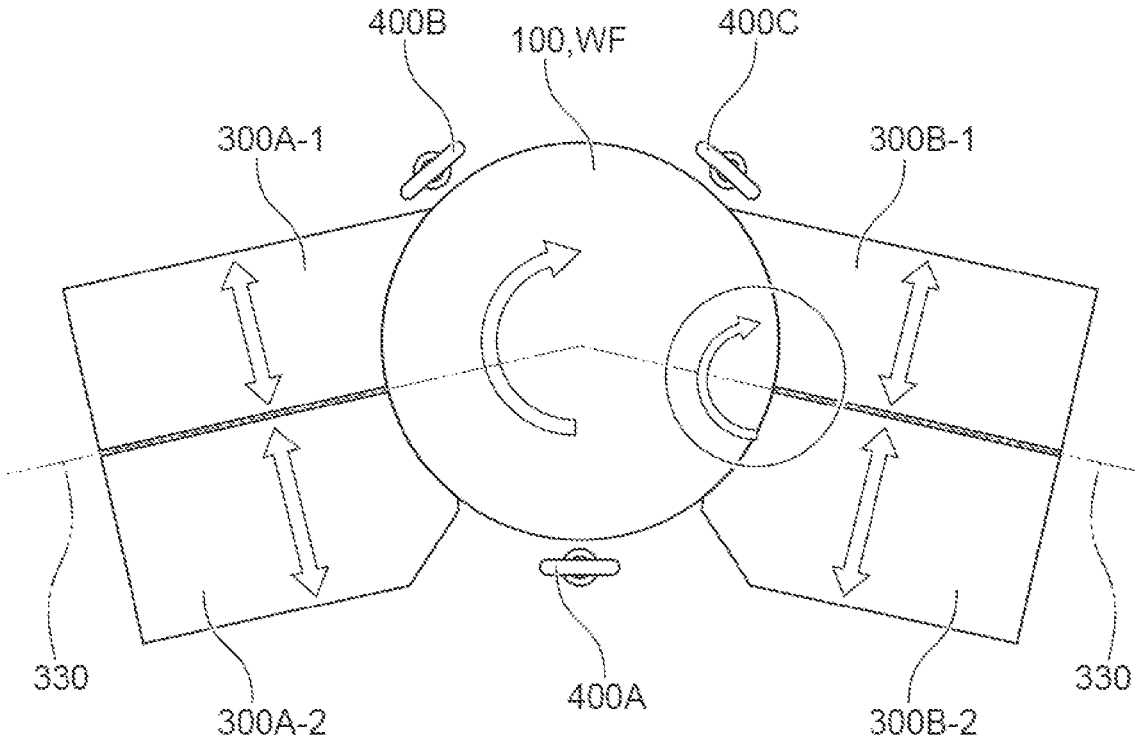
FIG. 12 is a plan view schematically illustrating a supporting member according to one embodiment.
Figure 13:
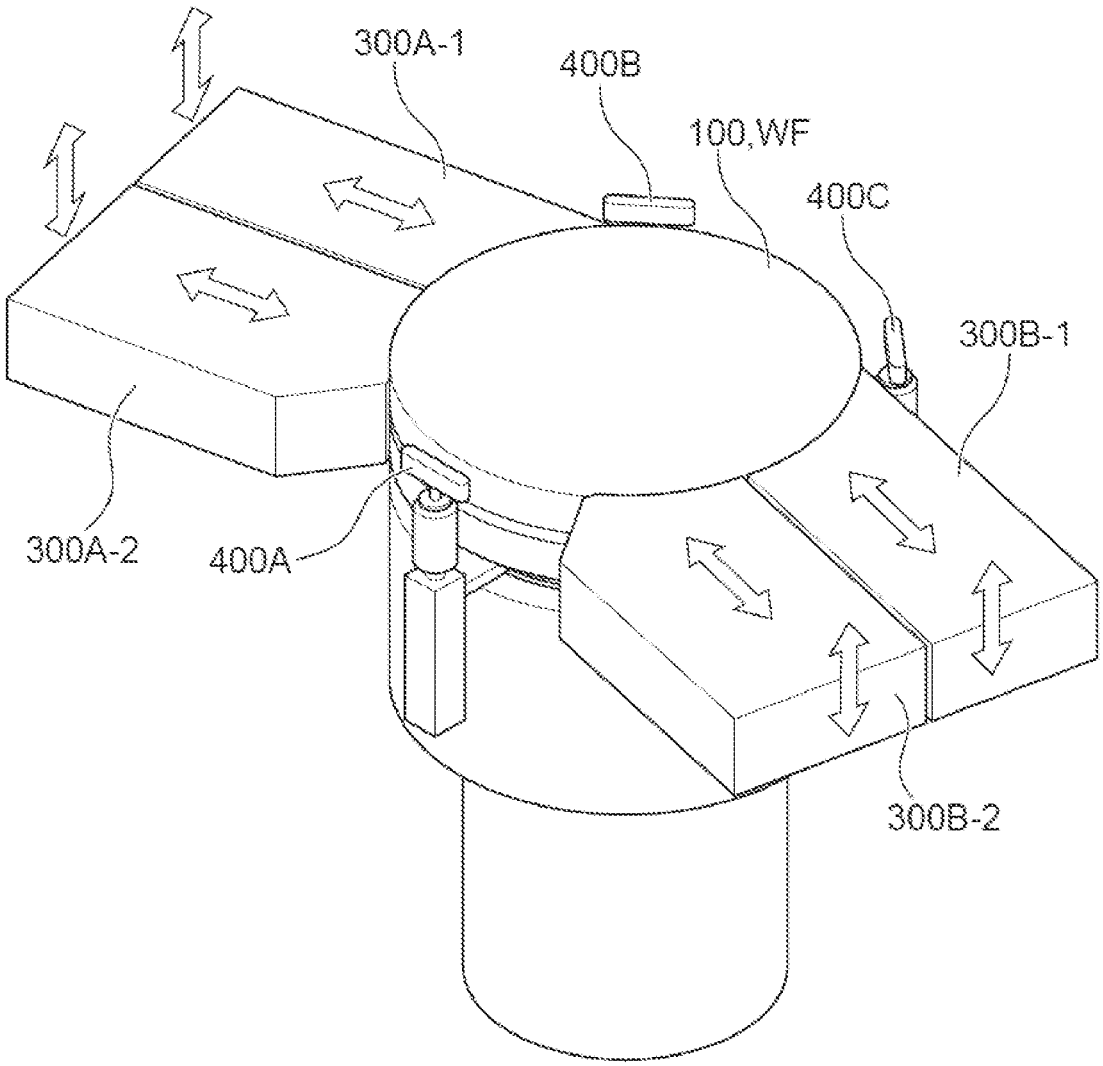
FIG. 13 is a perspective view schematically illustrating the supporting member according to one embodiment.

Next, a modification of the supporting member 300 will be described. FIG. 12 is a plan view schematically illustrating the supporting member according to one embodiment. FIG. 13 is a perspective view schematically illustrating the supporting member according to one embodiment. As illustrated in FIG. 12 and FIG. 13, the supporting members 300A and 300B each include a plurality (two in this embodiment) of supporting members divided with virtual division lines 330 along the radial direction of the substrate WF interposed therebetween. Specifically, the supporting member 300A includes a supporting member 300A-1 and a supporting member 300A-2 divided with the division line 330 interposed therebetween. The supporting member 300B includes a supporting member 300B-1 and a supporting member 300B-2 divided with the division line 330 interposed therebetween.

In the embodiment, the driving mechanisms 310 and 320 are disposed for each of the plurality of supporting members 300 (the supporting member 300A-1, the supporting member 300A-2, the supporting member 300B-1, and the supporting member 300B-2). Accordingly, the driving mechanisms 310 and 320 can adjust at least one of the height and the distance to the substrate WF of the supporting member 300 while polishing the substrate WF independently, for each of the plurality of supporting members 300. For example, when the polishing pad 222 swings while rotating clockwise as illustrated in FIG. 12, the supporting member 300B-1 has a role to support the polishing pad 222 rotating toward the supporting member 300B from the substrate WF. On the other hand, the supporting member 300B-2 has a role to support the polishing pad 222 rotating toward the substrate WF from the supporting member 300B. Therefore, for example, the driving mechanisms 310 and 320 can adjust the height position of the supporting member 300B-1 and the supporting member 300B-2 such that the support surface of the supporting member 300B-2 becomes higher than the support surface of the supporting member 300B-1.

Figure 14:
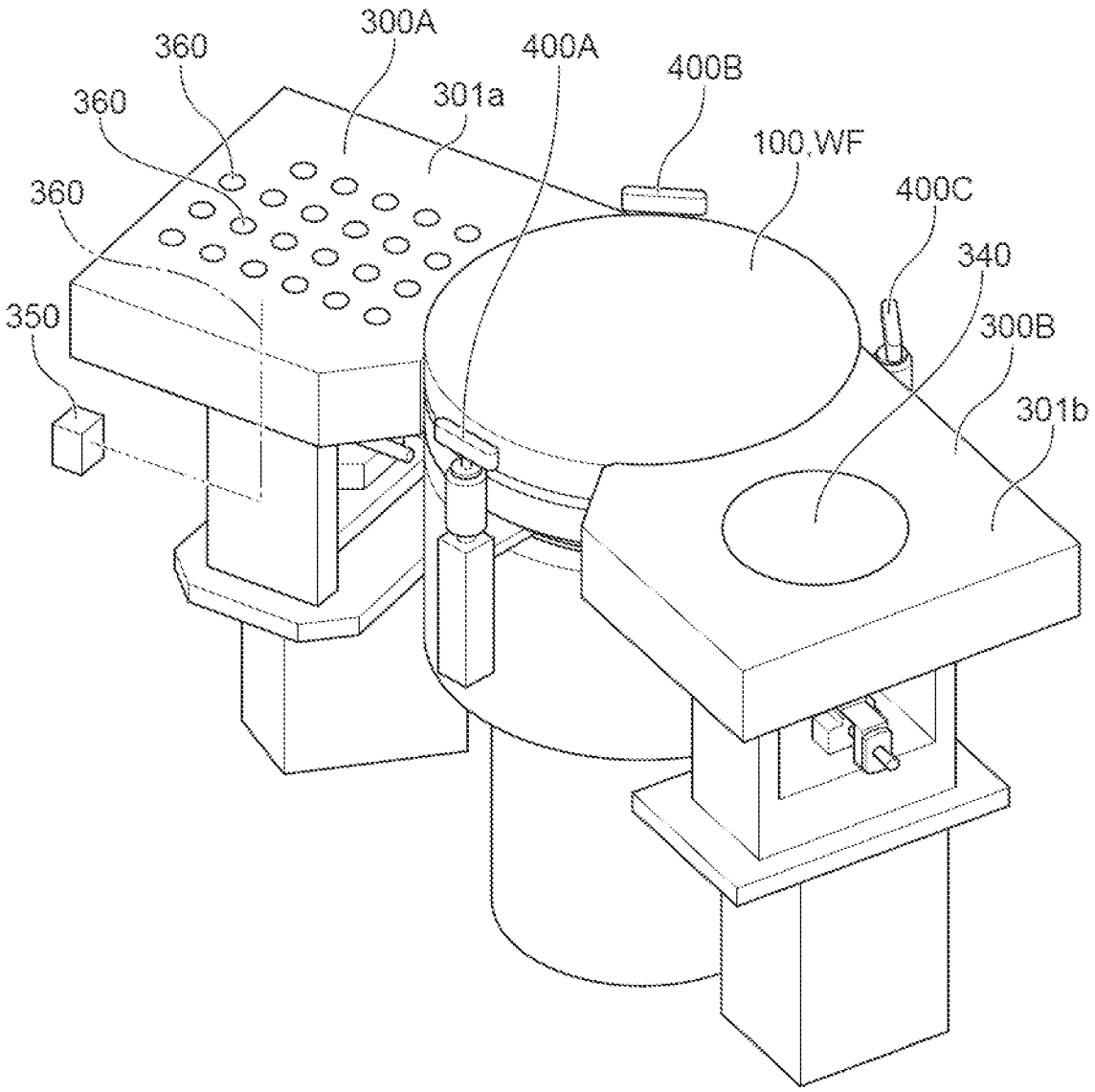
FIG. 14 is a perspective view schematically illustrating the supporting member according to one embodiment.

Next, another modification of the supporting member 300 will be described. FIG. 14 is a perspective view schematically illustrating a supporting member according to one embodiment. As illustrated in FIG. 14, the supporting member 300B has the support surface 301*b* in which a dresser 340 for toothing the polishing pad 222 is implanted. The embodiment ensures simultaneously toothing the polishing pad 222 when the polishing pad 222 swings above the supporting member 300B while polishing the substrate WF.

As illustrated in FIG. 14, the supporting member 300A has the support surface 301*a* in which a plurality of vacuum passages 360 communicated with a vacuum member 350 configured of a pump and the like for vacuuming a gas is implanted. The embodiment ensures vacuuming polishing dust and the like attached on the polishing pad 222 when the polishing pad 222 swings above the supporting member 300A during polishing of substrate WF since the vacuum passages 360 communicated with the vacuum member 350 open on the support surface 301*a*.

The embodiment of the present invention has been described above in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

This application discloses, as one embodiment, a substrate processing apparatus including: a table for supporting a substrate; a pad holder for holding a polishing pad for polishing the substrate supported by the table; an elevating mechanism for elevating the pad holder with respect to the substrate; a swing mechanism for swinging the pad holder in a radial direction of the substrate; a supporting member for supporting the polishing pad swung to outside the table by the swing mechanism; and a driving mechanism for adjusting at least one of a height and a distance to the substrate of the supporting member while polishing the substrate.

This application further discloses, as one embodiment, the substrate processing apparatus in which the supporting member includes a first supporting member arranged in a swing path of the polishing pad outside the table and a second supporting member arranged in a swing path of the polishing pad at an opposite side of the first supporting member across the table.

This application further discloses, as one embodiment, the substrate processing apparatus in which the first supporting member and the second supporting member each have a support surface configured to support a whole polishing surface of the polishing pad, the polishing surface being to be brought into contact with the substrate.

This application further discloses, as one embodiment, the substrate processing apparatus further including a film thickness measuring instrument for measuring a film thickness profile of a surface to be polished of the substrate while polishing the substrate, in which the driving mechanism is configured to adjust at least one of the height and the distance to the substrate of the supporting member in accordance with the film thickness profile measured by the film thickness measuring instrument.

This application further discloses, as one embodiment, the substrate processing apparatus in which the driving mechanism is configured such that the driving mechanism lowers the height of the supporting member or widens the distance to the substrate of the supporting member when a film thickness on an edge portion of the substrate is thicker than a film thickness in a center portion in the film thickness profile measured by the film thickness measuring instrument.

This application further discloses, as one embodiment, the substrate processing apparatus further including a substrate thickness measuring instrument for measuring a thickness of the substrate installed on the table, in which the driving mechanism is configured to adjust the height of the supporting member based on the thickness of the substrate measured by the substrate thickness measuring instrument.

This application further discloses, as one embodiment, the substrate processing apparatus further including a diameter measuring instrument for measuring a diameter of the substrate installed on the table, in which the driving mechanism is configured to adjust the distance to the substrate of the supporting member based on the diameter of the substrate measured by the diameter measuring instrument.

This application further discloses, as one embodiment, the substrate processing apparatus in which the supporting member includes a plurality of supporting members divided by a virtual division line, the virtual division line running along the radial direction of the substrate, and the driving mechanism is configured to adjust at least one of the height and the distance to the substrate of the supporting member while polishing the substrate independently, for each of the plurality of supporting members.

This application further discloses, as one embodiment, the substrate processing apparatus in which the supporting member has a support surface for supporting a polishing surface of the polishing pad, the polishing surface being to be brought into contact with the substrate, the support surface of the supporting member having an implanted dresser for toothing the polishing pad.

This application further discloses, as one embodiment, the substrate processing apparatus in which the supporting member has a support surface for supporting a polishing surface of the polishing pad, the polishing surface being to be brought into contact with the substrate, the support surface of the supporting member having an implanted vacuum passage communicated with a vacuum member.

This application further discloses, as one embodiment, the substrate processing apparatus in which the swing mechanism includes a first arm for holding the pad holder, a second arm for holding a cleaning tool holder for holding a cleaning tool, a third arm for holding a pad holder for holding a polishing pad with a diameter different from a diameter of the polishing pad, a fourth arm for holding a photographing member, a swing shaft that supports the first, second, third, and fourth arms, and a rotation drive mechanism for rotatably driving the swing shaft, and each of the first, second, third, and fourth arms is radially arranged in a peripheral area of the swing shaft.

This application further discloses, as one embodiment, the substrate processing apparatus in which the second arm is configured to further hold atomizers together with the cleaning tool, the atomizers being arranged at both sides of the cleaning tool.

This application further discloses, as one embodiment, a substrate processing method including: an installing step of installing a substrate on a table; a pressing step of pressing a polishing pad against the substrate, the polishing pad being for polishing the substrate installed on the table; a swinging step of swinging the polishing pad in a radial direction of the substrate; and an adjusting step of adjusting at least one of a height and a distance to the substrate of a supporting member while polishing the substrate, the supporting member being for supporting the polishing pad swung to outside the table in the swinging step.

This application further discloses, as one embodiment, the method further including a film thickness measuring step of measuring a film thickness profile of a surface to be polished of the substrate while polishing the substrate, in which the adjusting step includes adjusting at least one of the height and the distance to the substrate of the supporting member in accordance with the film thickness profile measured in the film thickness measuring step.

This application further discloses, as one embodiment, the method in which the adjusting step includes lowering the height of the supporting member or widening the distance to the substrate of the supporting member when a film thickness on an edge portion of the substrate is thicker than a film thickness in a center portion in the film thickness profile measured in the film thickness measuring step.

REFERENCE SIGNS LIST

100 . . . table
200 . . . multi-axis arm
210 . . . swing shaft
212 . . . rotation drive mechanism (swing mechanism)
220 . . . first arm
222 . . . polishing pad
**222*a*** . . . polishing surface
226 . . . pad holder
227 . . . elevating mechanism
238 . . . atomizer
300 . . . supporting member
300A . . . first supporting member
300A-1 . . . supporting member
300A-2 . . . supporting member

300B . . . second supporting member
300B-1 . . . supporting member
300B-2 . . . supporting member
301*a*, 301*b* . . . support surface
310, 320 . . . driving mechanism
330 . . . division line
340 . . . dresser
350 . . . vacuum member
360 . . . vacuum passage
400 . . . diameter measuring instrument
600 . . . film thickness measuring instrument
630 . . . substrate thickness measuring instrument
810 . . . film thickness profile
820 . . . film thickness profile
1000 . . . substrate processing apparatus
WF . . . substrate

What is claimed is:

1. A substrate processing apparatus comprising:

a table for supporting a substrate;

a pad holder for holding a polishing pad for polishing the substrate supported by the table;

an elevating mechanism for elevating the pad holder with respect to the substrate;

a swing mechanism for swinging the pad holder in a radial direction of the substrate;

a supporting member for supporting the polishing pad swung to outside the table by the swing mechanism; and a driving mechanism for adjusting at least one of a height and a distance to the substrate of the supporting member while polishing the substrate, wherein the supporting member has a support surface for supporting a polishing surface of the polishing pad, the polishing surface being to be brought into contact with the substrate, the support surface of the supporting member having an implanted vacuum passage communicated with a vacuum member.

2. The substrate processing apparatus according to claim 1, wherein the supporting member includes a first supporting member arranged in a swing path of the polishing pad outside the table and a second supporting member arranged in a swing path of the polishing pad at an opposite side of the first supporting member across the table.

3. The substrate processing apparatus according to claim 2, wherein the first supporting member and the second supporting member each have a support surface configured to support a whole polishing surface of the polishing pad, the polishing surface being to be brought into contact with the substrate.

4. The substrate processing apparatus according to claim 1, further comprising a film thickness measuring instrument for measuring a film thickness profile of a surface to be polished of the substrate while polishing the substrate, wherein the driving mechanism is configured to adjust at least one of the height and the distance to the substrate of the supporting member in accordance with the film thickness profile measured by the film thickness measuring instrument.

5. The substrate processing apparatus according to claim 4, wherein the driving mechanism is configured such that the driving mechanism lowers the height of the supporting member or widens the distance to the substrate of the supporting member when a film thickness on an edge portion of the substrate is thicker than a film thickness in a center portion in the film thickness profile measured by the film thickness measuring instrument.

6. The substrate processing apparatus according to claim 1, further comprising a substrate thickness measuring instrument for measuring a thickness of the substrate installed on the table, wherein the driving mechanism is configured to adjust the height of the supporting member based on the thickness of the substrate measured by the substrate thickness measuring instrument.

7. The substrate processing apparatus according to claim 1, further comprising a diameter measuring instrument for measuring a diameter of the substrate installed on the table, wherein the driving mechanism is configured to adjust the distance to the substrate of the supporting member based on the diameter of the substrate measured by the diameter measuring instrument.

8. The substrate processing apparatus according to claim 1, wherein the supporting member includes a plurality of supporting members divided by a virtual division line, the virtual division line running along the radial direction of the substrate, and the driving mechanism is configured to adjust at least one of the height and the distance to the substrate of the supporting member while polishing the substrate independently, for each of the plurality of supporting members.

9. The substrate processing apparatus according to claim 1, wherein the support surface of the supporting member has an implanted dresser for toothing the polishing pad.

10. A substrate processing apparatus comprising:

a table for supporting a substrate;

a pad holder for holding a polishing pad for polishing the substrate supported by the table;

an elevating mechanism for elevating the pad holder with respect to the substrate;

a swing mechanism for swinging the pad holder in a radial direction of the substrate;

a supporting member for supporting the polishing pad swung to outside the table by the swing mechanism; and a driving mechanism for adjusting at least one of a height and a distance to the substrate of the supporting member while polishing the substrate, wherein the swing mechanism includes a first arm for holding the pad holder, a second arm for holding a cleaning tool holder for holding a cleaning tool, a third arm for holding a pad holder for holding a polishing pad with a diameter different from a diameter of the polishing pad, a fourth arm for holding a photographing member, a swing shaft that supports the first, second, third, and fourth arms, and a rotation drive mechanism for rotatably driving the swing shaft, and each of the first, second, third, and fourth arms is radially arranged in a peripheral area of the swing shaft.

11. The substrate processing apparatus according to claim 10, wherein the second arm is configured to further hold atomizers together with the cleaning tool, the atomizers being arranged at both sides of the cleaning tool.

* * * * *